US012601227B2

(12) United States Patent
Rodrigues et al.

(10) Patent No.: US 12,601,227 B2
(45) Date of Patent: Apr. 14, 2026

(54) DOWNHOLE CONCENTRIC WET-MATE CONNECTOR

(71) Applicant: Halliburton Energy Services, Inc., Houston, TX (US)

(72) Inventors: Desiderio Naegele Rodrigues, Rio de Janeiro (BR); Jorge Arturo Hinostroza Medina, Rio de Janeiro (BR); Christian Willian Almeida da Silva, Rio de Janeiro (BR)

(73) Assignee: Halliburton Energy Services, Inc., Houston, TX (US)

( * ) Notice: Subject to any disclaimer, the term of this patent is extended or adjusted under 35 U.S.C. 154(b) by 5 days.

(21) Appl. No.: 18/816,487

(22) Filed: Aug. 27, 2024

(65) Prior Publication Data

US 2026/0063004 A1 Mar. 5, 2026

(51) Int. Cl.
*E21B 17/02* (2006.01)

(52) U.S. Cl.
CPC ..... *E21B 17/0285* (2020.05)

(58) Field of Classification Search
CPC .. E21B 17/028; E21B 17/0285; E21B 17/003; H01R 13/523; H01R 13/5219
See application file for complete search history.

(56) References Cited

U.S. PATENT DOCUMENTS 4,483,393 A * 11/1984 More ..... G01V 3/20 166/65.1
4,624,484 A * 11/1986 Wilson ..... F16L 13/004 29/247
5,194,012 A * 3/1993 Cairns ..... H01R 13/523 439/271
5,577,925 A 11/1996 Schnatzmeyer et al.
9,695,645 B2 7/2017 Tilley et al.
10,969,260 B1 * 4/2021 Thompson ..... G01F 1/584
11,105,160 B2 8/2021 Leismer et al.
12,024,955 B2 * 7/2024 Mahendran ..... E21B 34/085
2003/0213598 A1 * 11/2003 Hughes ..... E21B 17/003 166/242.6
2018/0030813 A1 * 2/2018 Smith ..... E21B 28/00
2018/0073652 A1 * 3/2018 Weintraub ..... F16K 11/065
(Continued)

FOREIGN PATENT DOCUMENTS

AU 5991801 A 4/2002
WO 2015107358 A2 7/2015

OTHER PUBLICATIONS

Application No. PCT/US2024/047392 , International Search Report and Written Opinion, mailed on May 21, 2025, 12 pages.

*Primary Examiner* — Kipp C Wallace
(74) *Attorney, Agent, or Firm* — Kilpatrick Townsend & Stockton, LLP

(57) ABSTRACT

A concentric wet-mate connector assembly can include a male portion having a male electrical contact and a male insulation band positionable on a surface of the male portion. The wet-mate connector assembly can also include a female portion having a female electrical contact and a ceramic female insulation band formable on a surface of the female portion. The female portion the wet-mat connector assembly is positionable to receive the male portion to form an electrical connection with the male portion, where the male insulation band and the ceramic female insulation band together form an insulator chamber of the concentric wet-mate connector assembly.

20 Claims, 6 Drawing Sheets

(56) References Cited

U.S. PATENT DOCUMENTS

| | | | | |
|---|---|---|---|---|
| 2019/0119990 | A1* | 4/2019 | Fredriksen | E21B 17/028 |
| 2019/0195028 | A1* | 6/2019 | Fripp | H01R 13/15 |
| 2020/0014183 | A1* | 1/2020 | Bang-Andreasen | F16L 1/123 |
| 2021/0140247 | A1 | 5/2021 | Bishop et al. | |
| 2022/0034170 | A1* | 2/2022 | Lafleur | H01R 13/523 |
| 2023/0131231 | A1* | 4/2023 | Minassa | H01R 43/26 439/190 |
| 2023/0208075 | A1* | 6/2023 | Zhong | H01R 43/005 439/271 |

* cited by examiner

DOWNHOLE CONCENTRIC WET-MATE CONNECTOR

TECHNICAL FIELD

The present disclosure relates generally to wellbore operations and, more particularly (although not necessarily exclusively), to a concentric wet-mate connector assembly for downhole power transmission within a wellbore.

BACKGROUND

A wellbore can be a hole that can be drilled into a subterranean formation. After the wellbore has been drilled, the wellbore can be completed to prepare the wellbore for extraction of natural resources, such as oil, gas, or water from the wellbore. Completing the wellbore can involve running production tubing, electrical lines, and downhole tools into the wellbore. The wellbore may contain one or more downhole fluids, such as water, drilling fluid, formation fluid, oil, mud, or brine. Electricity and data communications equipment may be installed in wet environments downhole within the wellbore. A connector assembly may form an electrical connection between electrical or control lines at points along a length of the wellbore.

DETAILED DESCRIPTION

Figure 1:
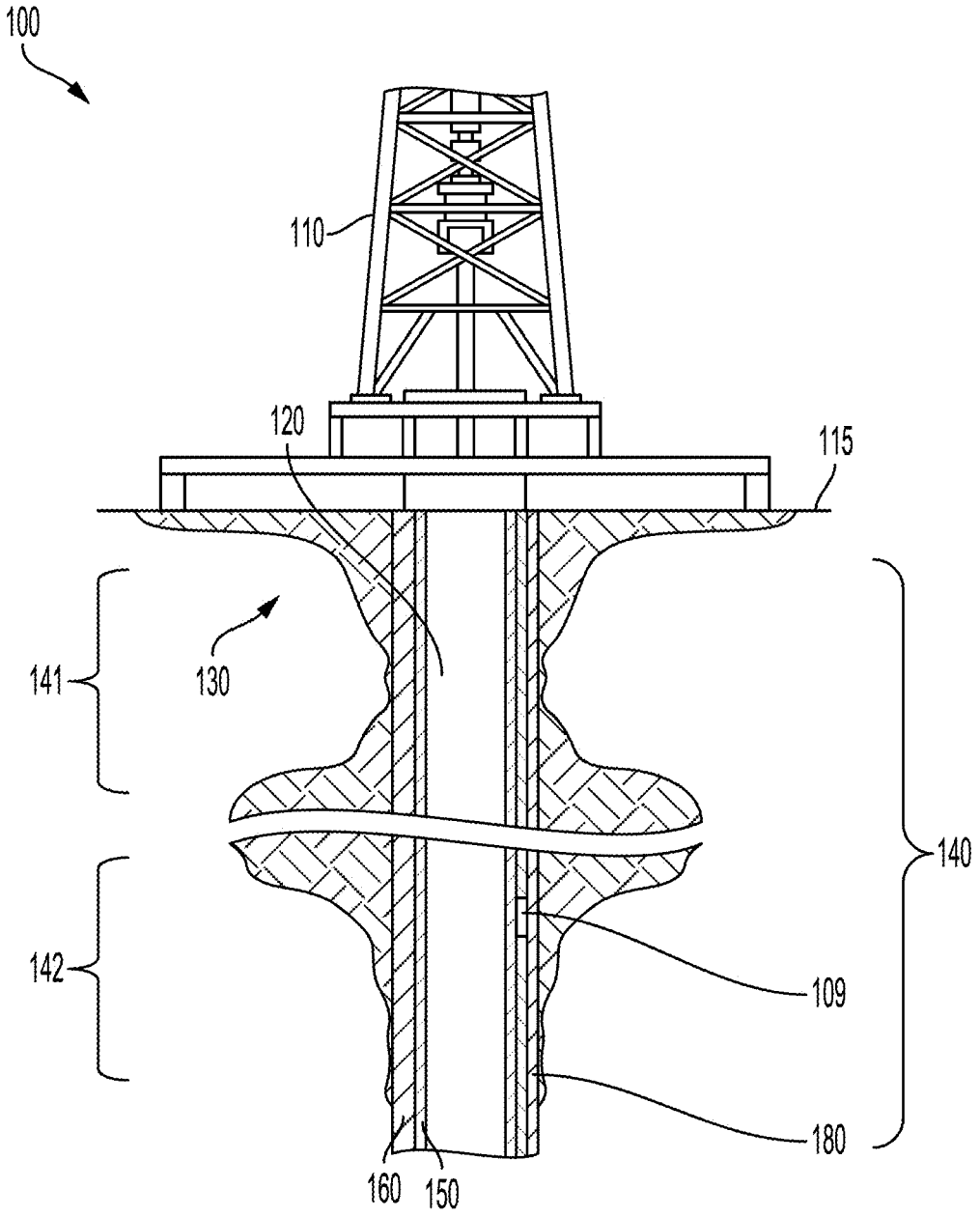
FIG. 1 is a schematic view of a well system that includes a concentric wet-mate connector assembly according to one example of the present disclosure.

Certain aspects and examples of the present disclosure relate to a concentric wet-mate connector assembly with a ceramic insulation band for downhole power transmission within a wellbore. The concentric wet-mate connector assembly can include two portions, such as a male portion and a female portion, which can be mechanically mated together to make an electrical connection. The male portion and the female portion can each have an insulation band formed of different materials. In one example, the female insulation band can be a ceramic material. In additional examples, the male and female insulation bands can be formed from thermoplastics, glass fiber reinforced plastics, ceramic powder reinforced plastics, dielectric coasted metals, or any combination of these materials. The male and female insulation bands can be formed from the same materials or from different materials.

When the male portion and the female portion are mated together, the contact chamber formed by the male insulation band and the female insulation band can prevent the electrical connection from short-circuiting through exposure to conductive fluids in the wellbore. The use of a ceramic insulation band enables wider operating ranges for the concentric wet-mate connector assembly (e.g., temperature, pressure, voltage, and power throughput).

In examples described by the present disclosure, the male and female insulation bands are formable directly on the male and female portions without the use of elastomers. Through the elimination of elastomeric materials, the concentric wet-mate connector assembly can have improved structural integrity at high voltages (e.g., up to 5,000 V) and high power (e.g., up to 5,000 W). The improved structural integrity can also enable operation of the concentric wet-mate connector assembly at a large range of temperatures (e.g., from −100° C. to 250° C.) and high pressures (e.g., up to 30,000 PSI). By minimizing or eliminating elastomeric elements from the concentric wet-mate connector assembly, it is possible for the concentric wet-mate connector assembly to function in a wide range of pressures and temperatures.

In one example, the concentric wet-mate connector assembly may include two main elements. The first element may be a female portion (e.g., resident portion) that can remain in a wellbore for the service life of the downhole tool of the wellbore. The second element of the concentric wet-mate connector assembly is a male portion (e.g., a retrievable element) that is used to mate with the female portion to thereby form an electrical connection. The male portion can attach to an upper completion tubing string (e.g., a section of the female portion). The female portion can include a female electrical contact (e.g., receptable connector) that can be housed by a metal element as a female chassis. Similarly, the male portion can include a male electrical contact (e.g., retrievable connector) that can be housed by a metal element as a male chassis. When the female portion and the male portion are mated together, the female chassis that houses the female portion and the male chassis that houses the male portion can be coaxial with the wellbore. To enable electrical connections in a wellbore environment, the male portion and the female portion each may include an insulation band that, when joined together, form a dielectric insulated contact chamber of the concentric wet-mate connector assembly. The female insulation band can be formed from a ceramic material and positioned on a surface of the female portion (e.g., attached to the female chassis). The female electrical contact can be centered in the female insulation band. In one example, the female electrical contact can be mated inside the female insulation band and the female electrical contact can be connected to a female electrical termination that is tied to a control line that may run to the end of the downhole tool in the wellbore.

The male portion can include elements similar to the female portion. For example, the male portion can include a male electrical contact having a similar construction as the female portion (e.g., housed by a metal element as a male chassis). The female portion can receive the male portion such that the male electrical contact contacts the female electrical contact when mated thereby enabling a conductive path for electrons to flow. In some examples, the male electrical contact may be a male electrical contact ring and the female electrical contact may be a female electrical contact ring. In other examples, the male electrical contact can be referred to as a male contact collet. The male contact collet can be housed by a male insulation band, which may be attached to the male portion without the use of elastomers and housed by the male chassis. In an example, the female portion can coaxially receive the male portion. The male portion can additionally include a male electrical termination similar to the female electrical termination of the female portion. The male electrical termination can be coupled to the male electrical contact to provide an electrical path to an up-hole location, such as the surface of the well.

In some examples, both the male electrical contact and the female electrical contact can be pressure compensated. Additionally, when the female portion receives the male portion, a contact chamber can be formed at the interface between the female portion and the male portion. The contact chamber can be pressure compensated to match the male electrical contact compensation chamber to avoid a generation of differential pressure across the multiple chambers.

In some examples, the female portion of the concentric wet-mate connector assembly can include a female insulation band that is formed directly on the surface of the female portion of the female chassis without the use of elastomers. As mentioned previously, the female insulation band can be formed from a ceramic material. The female insulation band can be joined to the female portion through a solid-solid interface by a shrink fit joining method. The materials, the elimination of elastomers, and the improved solid-solid interface dielectric strength (e.g., improved electric insulation resistance), as described by the present disclosure, increase the insulation resistance and the structural stability of the concentric wet-mate connector once the female portion and the male portion are mated together and subjected the expected stresses associated with wellbore operations.

Additionally, the techniques described herein widen the application range of the concentric wet-mate connector assembly to higher and lower temperatures as well as higher operating electrical parameters, such as voltage and power throughput. In some examples, the concentric wet-mate connector assembly of the present disclosure can operate at temperatures ranging from −100° C. to 225° C., and the electrical parameters can include a voltage up to 5,000 V and up to 5,000 W power throughput. The concentric wet-mate connector of the present disclosure can also be extended for use in any downhole wet-mate electrical connection (e.g., subsea conditions, sand control operations, carbon storage wells, etc.) between a resident (e.g., female portion) and a retrievable element (e.g., male portion).

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic view of a well system 100 according to one example of the present disclosure. The well system 100 includes an exemplary operating environment in which the apparatuses, systems and methods disclosed herein may be employed. For example, the well system 100 can include a control line 180 according to any of the embodiments, aspects, applications, variations, or designs disclosed in the following paragraphs. The well system 100 can include a workover or drilling rig 110 that can be positioned above the earth's surface 115 and can extend over and around a wellbore 120 that can penetrate a subterranean formation 130 for the purpose of recovering hydrocarbons, for example. The subterranean formation 130 can be located below exposed earth, as shown, as well as areas below earth covered by water, such as ocean or fresh water. Some aspects of the present disclosure may be particularly suited for subterranean formations 130 located below the earth covered by water. As those skilled in the art appreciate, the wellbore 120 can be fully cased, partially cased, have multiple concentric wellbore tubulars, or an open hole wellbore. The casing can also be a liner that extends partway to the surface.

The wellbore 120 may be drilled into the subterranean formation 130 using any suitable drilling technique. In the example illustrated in FIG. 1, the wellbore 120 extends substantially vertically away from the earth's surface 115. Notwithstanding, in other embodiments the wellbore 120 could include a vertical wellbore portion, deviate from vertical relative to the earth's surface 115 over a deviated wellbore portion, and then transition to a horizontal wellbore portion. In alternative operating environments, all or portions of a wellbore 120 may be vertical, deviated at any suitable angle, horizontal, or curved. The wellbore 120 can be a new wellbore, an existing wellbore, a straight wellbore, an extended reach wellbore, a sidetracked wellbore, a multilateral wellbore, or any other type of wellbore for drilling, completing, or the production of one or more zones. Further, the wellbore 120 may be used for both producing wells and injection wells. In accordance with the disclosure, the wellbore 120 may include a wellbore tubular 150. The wellbore tubular 150 can be wellbore casing that is held in place by cement 160 in the cased region 140. In some embodiments, the wellbore tubular 150 can be production tubing, a liner, the wellbore itself, or any other type of tubular that can be located within a wellbore.

The well system 100 can include the control line 180. For example, the control line 180 might extend within the wellbore 120 from the surface. A concentric wet-mate connector assembly 109 may enable a portion of the control line 180 positioned in an uphole region 141 of the wellbore 120 to form an electrical connection with a portion of the control line 180 positioned in a downhole region 142 of the wellbore 120. The concentric wet-mate connector assembly 109 can include an insulation band that can form an insulation layer around electrically charged portions of the concentric wet-mate connector assembly 109 that may have been exposed to downhole fluids.

Figure 2:
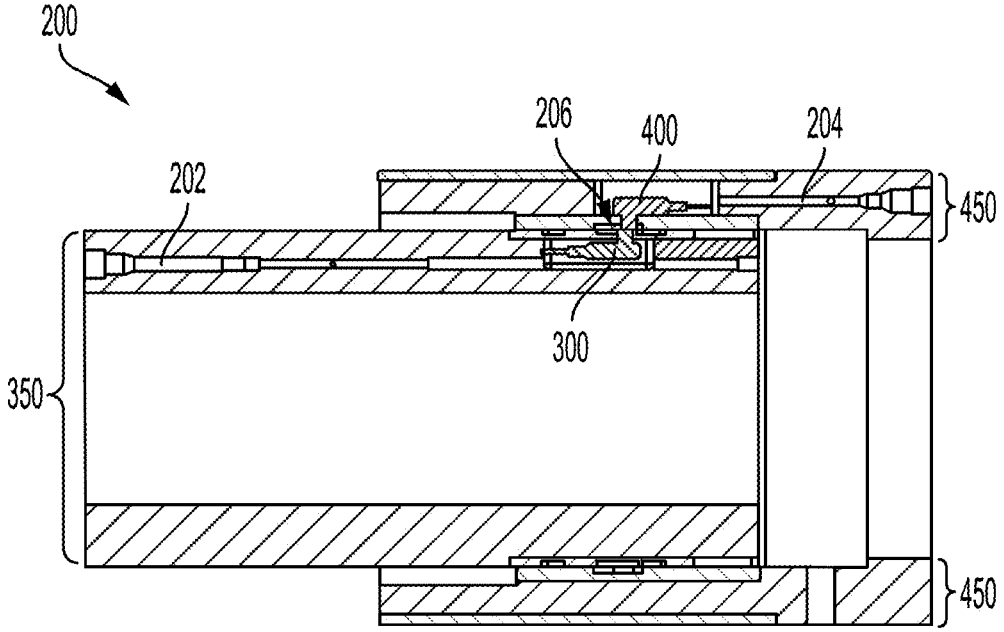
FIG. 2 is a cross-section view of a concentric wet-mate connector assembly according to one example of the present disclosure.

FIG. 2 is a cross-section view of a concentric wet-mate connector assembly 200 according to one example of the present disclosure. The concentric wet-mate connector assembly 200 can provide an electrical path for electrical signals to flow from an up-hole region 140, such as the surface of the well, to a downhole region 142. For example, formation of the electrical path by concentric wet-mate connector 200 can enable a portion of the control line 180 positioned in up-hole region 141 of the wellbore 120 to form an electrical connection with a portion of the control line 180 positioned in the downhole region 142 of the wellbore 120. In some examples, the portion of the control line 180 positioned in the up-hole region 141 may be electrically connected to surface equipment and the portion of the control line 180 positioned in the downhole region 142 may be electrically connected to a downhole tool. Forming an electrical connection to provide an electrical path along the control line 180 can enable a transmission of data, power, or both among the surface equipment and the downhole tool, such as between regions of the control line 180 depicted in FIG. 1.

The concentric wet-mate connector assembly 200 can include a male portion 300 and a female portion 400. The male portion 300 and the female portion 400 are described in more detail in relation to FIGS. 3-6. The similar elements of the concentric wet-mate connector assembly 200 therefore may share description as the corresponding element described in relation to FIGS. 3-6, and as a result, the description references prior discussion of similar functionality. In some examples, a portion of the control line 180 positioned in the up-hole region 140 of the wellbore 120 may be electrically connected to the male portion 300, and a portion of the control line 180 positioned in the downhole region 142 can be electrically connected to the female portion 400, or vice versa. Additionally, the male portion 300 may be formed on a male chassis 350, which be inserted into the female portion 400 that may be formed on the female chassis 450. When the male portion 300 is inserted into the female portion 400, the elements may mechanically engage to form the electrical connection. The female portion 400 may be positionable in the wellbore 120 such that the female portion 400 coaxially receives the male portion 300 when mated together. Additionally, the concentric wet-mate connector assembly 200 can be positioned so as to be coaxial with the wellbore 120. A wire pass 202 to up-hole region 140 and a wire pass 204 to downhole region 142 can protect the control line 180 as the control line 180 extends the length of the wellbore 120. Moreover, when the male portion 300 and the female portion 400 are mated together to form the concentric wet-mate connector assembly 200, a insulator chamber 206 can be defined in the space at the interface between the electrical contacts of the male portion 300 and the female portion 400.

Figure 3:
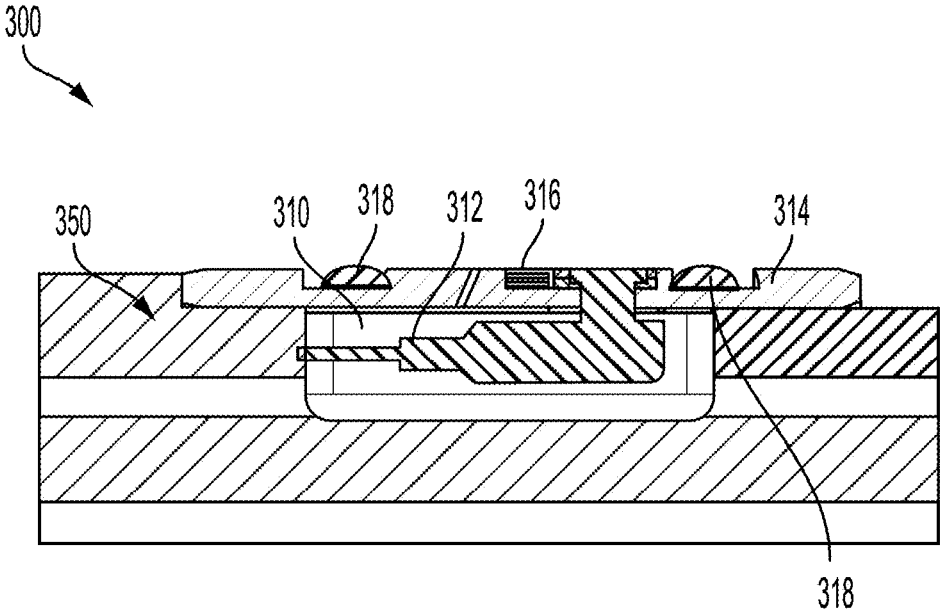
FIG. 3 is a cross-sectional view of a male portion of the concentric wet-mate connector assembly of FIG. 2 according to one example of the present disclosure.

FIG. 3 is a cross-sectional view of a male portion 300 of the concentric wet-mate connector assembly of FIG. 2 according to one example of the present disclosure. The male portion 300 of the concentric wet-mate connector assembly can be formed as part of a metal element referred to as a male chassis 350 which may be inserted into a wellbore to form an electrical connection with a female portion positioned within the wellbore. The male portion 300 can include a male electrical contact 316. The male electrical contact 316 can be machined into the metal core of the male portion 300 or the male electrical contact 316 can be mounted over a male insulation band 314. In some examples, the male electrical contact 316 can be referred to as a button contact point when the male portion 300 is mated with the female portion. Additionally, and although not illustrated in FIG. 3, the male portion can have multiple male electrical contacts to establish multiple electrical contact points between the male portion and the female portion of the concentric wet-mate connector assembly. In some examples, the male electrical contact 316 can be a single metal ring welded in place creating a 360° contact (e.g., a male concentric contact ring) formed around the male chassis 350.

The male portion 300 can also include a male compensated chamber 310. In some examples, the male compensated chamber 310 can be filled with silicone oil or other dielectric oil to insulate the electrical connection formed between the male portion 300 and the female portion of the concentric wet-mate connector assembly to thereby prevent the electrical connection from short-circuiting through exposure to conductive fluids in the wellbore. In some examples, the male compensated chamber 310 can also be pressure compensated. A male electrical termination 312 can be included within the male compensated chamber 310. The male electrical termination 312 can be electrically connected to the male electrical contact 316 and can provide an electrical path for the electrical signals to flow in control line 180. The male portion 300 can also include one or more contact chamber seals 318. The contact chamber seals 318 are described in more detail in relation to FIG. 5, but the contact chamber seals 318 can reduce an ingress of downhole fluids into the contact chamber formed when the male portion 300 and the female portion are connected together.

The male portion 300 can also include a male insulation band 314. The male insulation band 314 can be formed of nickel alloys, steel, or titanium materials. In some examples, the male insulation band 314 can include thin layer of dielectric coating formed on the top surface of the male insulation band 314 (e.g., the surface of the male portion that contacts the female portion). The thin layer of dielectric coating can be a parylene conformal coating (e.g., VT4 or F and AF4 or HT variants). In some examples, the thin layer of dielectric material can have a thickness varying from 1 to 500 microns that can generate electric insulation resistance the part while maintaining high strength from the metal core (e.g., the male electrical contact 316), which can be either low alloy steel, nickel alloys, or titanium. Additionally, the male insulation band 314 can be formed directly on a surface of the male portion 300 (e.g., an outer surface of the male chassis 350). When the male insulation band 314 is formed on the surface of the male portion 300, a chamber can be formed at the joining intersection of the components. Like the male compensated chamber 310, the chamber formed between the male insulation band 314 and the surface of the male portion 300 can be pressure compensated with a silicone fluid using a metal bellow or diaphragm.

Figure 4:
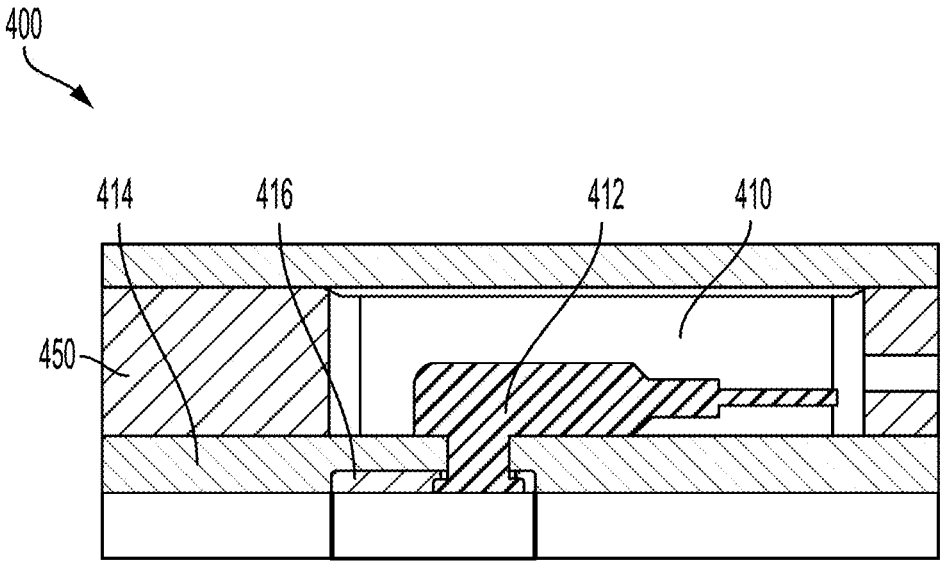
FIG. 4 is a cross-sectional view of a female portion of the concentric wet-mate connector assembly of FIG. 2 according to one example of the present disclosure.

FIG. 4 is a cross-sectional view of a female portion 400 of the concentric wet-mate connector assembly of FIG. 2 according to one example of the present disclosure. The female portion 400 of the concentric wet-mate connector assembly can be formed as part of a metal element referred to as a female chassis 450. The female chassis 450 can remain in a well, such as wellbore 120, for the service life of a downhole tool. Additionally, the female chassis 450 can be shaped to receive the male chassis 350 such that the male portion 300 and the female portion 400 can connect together to form the concentric wet-mate connector assembly.

The female portion 400 can include a female electrical contact 416. The female electrical contact 416 can be machined into the metal core of the female portion 400 of the female chassis 450 or the female electrical contact 416 can be mounted over a female insulation band 414. Additionally, and although not illustrated in FIG. 4, the female portion 400 can have multiple female electrical contacts to establish multiple electrical contact points between the male portion 300 and the female portion 400 of the concentric wet-mate connector assembly. In some examples, the female electrical contact 416 can be a single metal ring welded in place creating a 360° (e.g., a female concentric contact ring) formed around the female chassis 450.

In some examples, the female electrical contact 416 can be a vapor deposited metalized ring deposited into the female insulation band 414. In other examples, the female insulation band 414 can be a metal coated female insulation band 414. In these examples, the female electrical contact 416 can be the metal core of the metal coated female insulation band 414. The methods of coating the metal to form a metal coated female insulation band can include: hot sprayed Polyether-Ether-Ketone/Polyether-Ketone-Ketone (PEEK/PEKK) coating deposited via hot aspersion on the surface of the component followed by a curing treatment; hot sprayed Polyvinylidene Fluoride (PVDF) coating deposited via hot aspersion on the surface of the component followed by a curing treatment; amorphous silicon vapor deposited coating; immersion in epoxy resin; epoxy resin sprayed on and cured; or molded epoxy resin over a metal core.

The female portion 400 can also include a female insulation band 414. In some examples, the female insulation band 414 can be formed from a ceramic material and can be referred to as a ceramic female insulation band 414. In one example, Magnesia Partially Stabilized Zirconia (Mg-PSZ) can be used to form the ceramic female insulation band 414. Other ceramic materials may be used to form the ceramic female insulation 414 such as Silicon Nitride ($Si_3N_4$), Silicon Carbide (SiC), Yttria Partially Stabilized Zirconia (YPSZ), Single Crystal Sapphire, Ceria Partially Stabilized Zirconia (Ce-PSZ), fully stabilized zirconia, or Zirconia Toughened Alumina (ZTA). In yet another example, a metal-glass-ceramic material can be used as the female insulation band 414.

Various techniques can be used to join the female insulation band 414 to the female portion 400 of the female chassis 450 without the use of elastomers. One mechanism to join the female insulation band 414 to the female chassis 450 is through a shrink fit. A shrink fit can refer to a process of creating a geometrical interference with the elements at different temperature to allow for them to be mated. Through this process, a contact pressure will be generated by the interference between the parts. In one particular example, a shrink fit process can include heating the female chassis 450 to a temperature between 200° C. and 600° C. thereby enabling the female chassis 450 to thermally expand. Once thermally expanded, the female insulation band 414 can be inserted into the female portion 400. The contact pressure between the female insulation band 414 and the female portion 400 generated by the geometrical interference and the difference in coefficient of thermal expansion of the components can generate a single or multiple contact point that would create multiple intermediated chambers within the interface of the female portion 400 to generate a seal between the female insulation band 414 and the female portion 400.

In another example, a bonded shrink fit mechanism can be used to join the female insulation band 414 to the female portion 400 of the female chassis 450. The bonded shrink fit mechanism utilizes many of the same steps described above in relation to the shrink fit method but may include an additional epoxy or other high temperature resin, including copolymers as gap filler materials, formed between the female insulation band 414 and the female portion 400 of the female chassis 450 to create a hermetic seal between the two elements in combination with the geometrical interference.

In yet another example, and in the case of a metal-glass-ceramic female insulation band, a preformed glass cylinder can be inserted between the ceramic parts and the metal housing (e.g., between the female insulation band 414 and the female portion 400 of the female chassis 450). Following this step, a heat treatment utilizing a furnace can be applied to the components to change the temperature and phase of the preformed glass cylinder thereby melting the preformed glass cylinder to form the glass seal.

In yet another example, a metal-glass-metal seal method can be used to join the female insulation band 414 to the female portion 400 of the female chassis 450. The metal-glass-metal seal method follows similarly to the metal-glass-ceramic method described above but includes an additional step of depositing a thin layer dielectric coating material on the joining surface of the female insulation band 414. Additionally, or alternatively, any combination of the above-mentioned methods may be used to create the joint between the female insulation band 414 and the female portion 400 of the female chassis 450. Similar joining mechanisms can be used to join the male insulation band 314 to the male portion 300 of the male chassis 350 (e.g., glass-to-metal seal, epoxy resin bonded, or plastic static seal, etc.).

As mentioned previously, in some examples, the female insulation band 414 can include multiple female electrical contacts to create multiple independent electric channels. For example, each independent channel formed by the multiple female electrical contacts can have a separated chamber on the respective male insulation band 314 when the female portion 400 and the male portion 300 are mated together. The multi-channel wet-mate assembly connector with multiple connection points on the male portion 300 and the female portion 400 each may be isolated by separate contact seals thereby forming multiple contact chambers. Each of the multiple contact chambers can be independently compensated. In some examples, the multiple contact chambers may be non-compensated.

The female portion 400 can also include a female compensated chamber 410. The female compensated chamber 410 can be filled with silicone oil or other dielectric oil to insulate the electrical connection formed between the male portion 300 and the female portion 400 of the concentric wet-mate connector assembly to thereby prevent the electrical connection from short-circuiting through exposure to conductive fluids in the wellbore. In some examples, the female compensated chamber 410 can also be pressure compensated. A female electrical termination 412 can be included within the female compensated chamber 410. The female electrical termination 412 can be electrically connected to the female electrical contact 416 and can provide an electrical path for the electrical signals to flow in control line 180.

Figure 5:
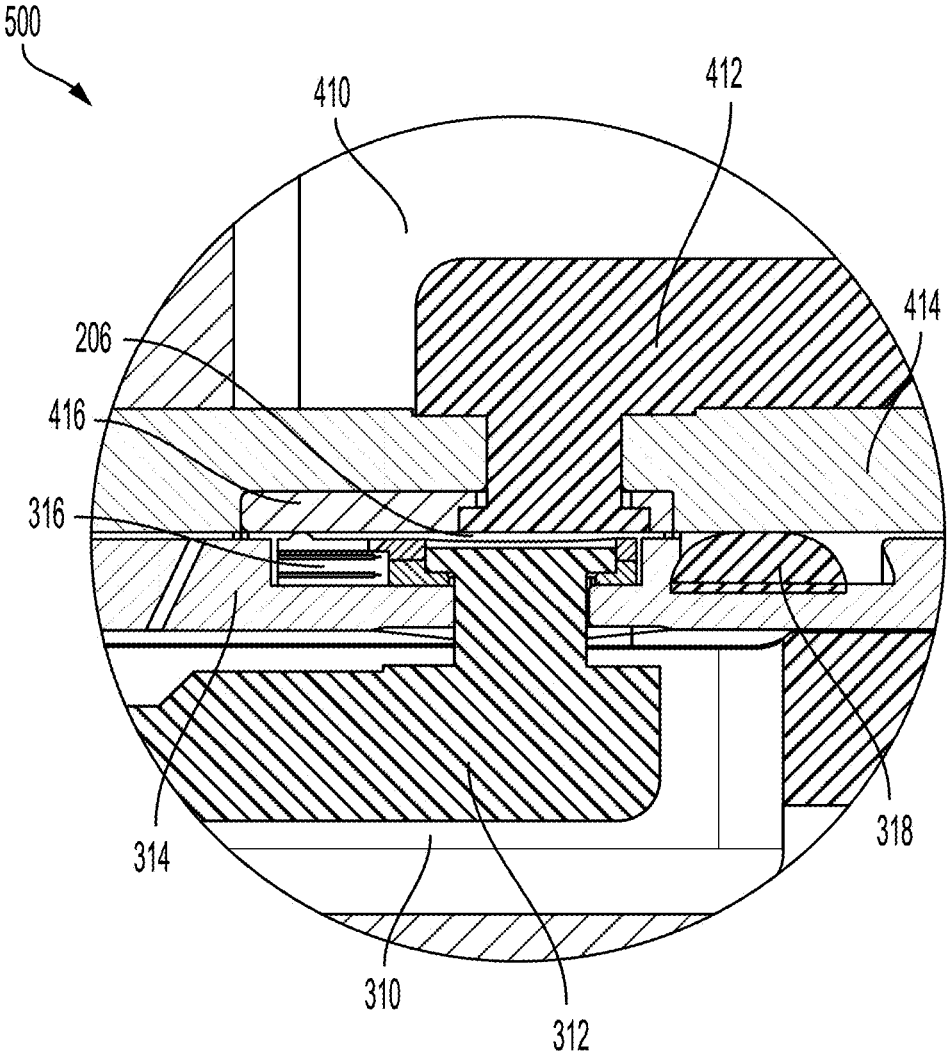
FIG. 5 is a cross-sectional view of an enlarged portion of the concentric wet-mate connector assembly FIG. 2 according to one example of the present disclosure.

FIG. 5 is a cross-sectional view of an enlarged portion 500 of the concentric wet-mate connector assembly FIG. 2 according to one example of the present disclosure. As illustrated by FIG. 5, the concentric wet-mate connector assembly can include the male portion 300 and the female portion 400. The male portion 300 can include the male electrical contact 316 and the female portion 400 can include the female electrical contact 416. An electrical connection can be formed between the male portion 300 and the female portion 400 in the insulator chamber 206 due to mechanical interference of the one or more electrical contacts. Forming the concentric wet-mate connector assembly between the male electrical contact 316 and the female electrical contact 416 can provide the electrical path for electrical signals to flow from an up-hole region 140, such as the surface of the well, to a downhole region 142 or vice versa.

In some examples, and although not illustrated in FIG. 5, the male electrical contact 316 and female electrical contact 416 can be fastened by one or more contact screws (not shown) to their respective male portion 300 and respective female portion 400. Additionally, and in some examples, the male electrical contact 316 and female electrical contact 416 can be contact rings that are concentric with respect to each other. For example, an outer diameter of a male electrical contact 316 may be sized to contact an inner diameter of a female electrical contact 416.

Staying with FIG. 5, when the male portion 300 and the female portion 400 are mated together to form the concentric wet-mate connector assembly, the insulator chamber 206 can be defined by the space at the interface between the male electrical contact 316 and the female electrical contact 416. In some examples, the insulator chamber 206 can be isolated from surrounding fluids present in wellbore operations using one or more contact chamber seals 318 positionable in the male insulator band 314. The contact chamber seals 318 can reduce an ingress of downhole fluids into the insulator chamber 206. For example, the contact chamber seal 318 can mechanically engage with the female insulation band 414. The contact chamber seal 318 may be formed by plastic energized seals, engineered elastomeric seals (e.g., hydrogenated acrylonitrile-butadiene rubber (HNBR), acrylonitrile-butadiene rubber (NBR), fluoroelastomer (FKM) material, perfluoroelastomer (FFKM) material) or other elements. Once mated, the insulator chamber 206 can be pressure balanced to the male compensated chamber 310 via a rubber bellow, diaphragm or a floating piston.

In some examples, the insulator chamber 206 can be further filled with dielectric grease. The dielectric grease can be a silicone-based material with additives to withstand a wide range of temperatures associated with the wellbore environment. In the examples where there are multiple contact points, all contact points shall be electrically isolated from each to provide independent channels.

As illustrated in FIG. 5, the male electrical contact 316 may be positionable within the male insulation band 314 (e.g., encapsulated by the male insulation band 314). Similarly, the female electrical contact 416 may be positionable within the female insulation band 414 (e.g., encapsulated by the female insulation band 414). When the female portion 400 receives the male portion 300 to form the concentric wet-mate connector assembly, an insulation band of the concentric wet-mate connector assembly is formable by joining the male insulation band 314 and the female insulation band 414 together. The insulation band of the concentric wet-mate connector assembly enables the concentric wet-mate connector assembly to self-isolate with respect to downhole fluids. Self-isolation may involve preventing undesired stray current paths from forming in the concentric wet-mate connector assembly. The insulation band can provide a high dielectric strength, which can protect the concentric wet-mate connector assembly from being corroded by downhole fluids that have contacted the connector assembly, increase the system's insulation resistance by preventing short-circuits, and improve the lifetime expectancy of the equipment. In one particular example, the female insulation band 414 can have high dielectric strength associated with high compression resistance to withstand the loads caused by the absolute pressure and the thermal expansion and contraction of all elements in its operating environment.

Figure 6:
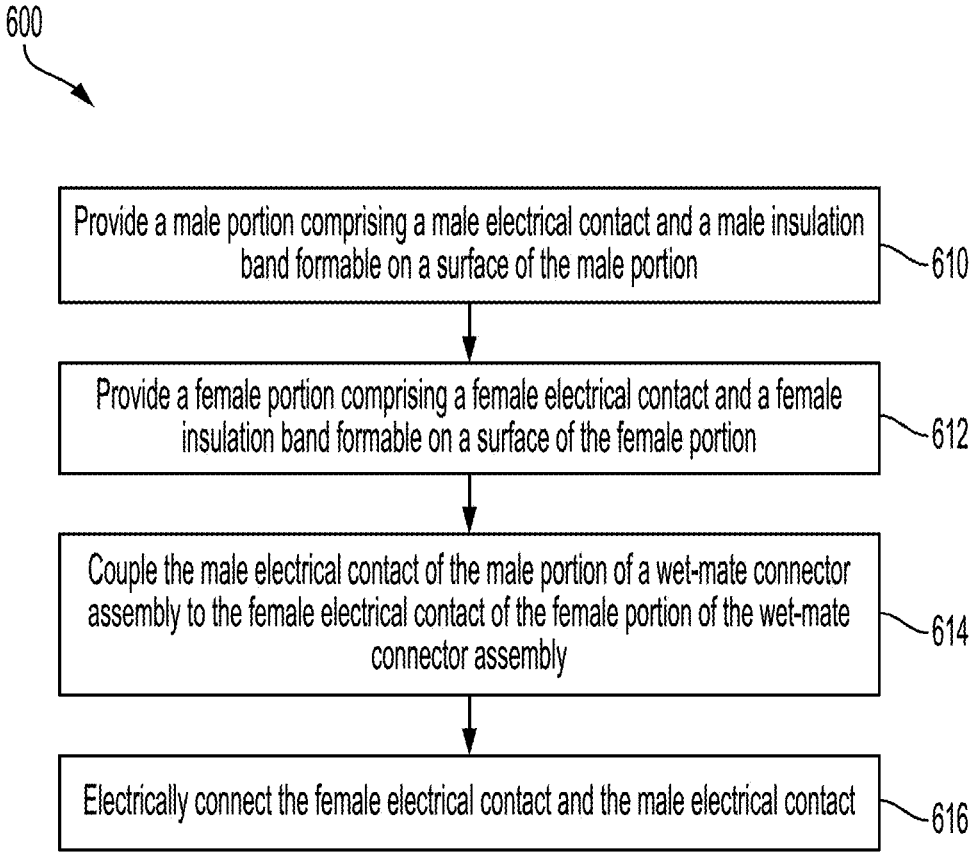
FIG. 6 is a flowchart of a process for electrically coupling a concentric wet-mate connector assembly according to one example of the present disclosure.

FIG. 6 is a flowchart of a process 600 for electrically connecting a concentric wet-mate connector assembly according to one example of the present disclosure. The steps of FIG. 6 are described with reference to the components of FIGS. 1-5. At block 610, the process 600 involves providing a male portion 300 comprising a male electrical contact 316 and a male insulation band 314 formable on a surface of the male portion 300. The male insulation band 314 can be formed directly on the surface of the male portion 300 without the use of elastomers and can be formed from nickel alloys, steel material, or titanium, for example. Additionally, the male electrical contact 316 can be a single metal ring welded in place creating a 360° contact (e.g., a male concentric contact ring) formed around the male portion 300 of the male chassis 350.

At block 612, the process 600 involves providing a female portion 400 comprising a female electrical contact 416 and a female insulation band 414 formable on a surface of the female portion 400, where the female insulation band 414 is formed on the surface of the female portion 400 through a shrink fit to create a hermetic seal between the female insulation band 414 and the surface of the female portion 400. In some examples, the female insulation band 414 can be referred to as a ceramic female insulation band formed of Mg-PSZ. Eliminating or reducing the use of elastomers by forming the male insulation band 314 and the female insulation band 414 directly on the male portion 300 and the female portion 400 enables improved structural integrity of the concentric wet-mate connector assembly at high voltages (up to 5,000 V) and high power (up to 5,000 W). The improved structural integrity also enables operation of the concentric wet-mate connector assembly for an increased range of temperatures from −100° C. to 250° C. and high pressure up to 30,000 PSI.

At block 614, the process 600 involves coupling the male electrical contact 316 of the male portion 300 of a concentric wet-mate connector assembly to the female electrical contact 416 of the female portion 400 of the concentric wet-mate connector assembly. Coupling the electrical contacts together can involve positioning the male electrical contact 316 adjacent to and in physical connection with the female electrical contact 416 such that an electrical connection is established. Additionally, through the coupling process, the male insulation band 314 and the female insulation band 414 can also join together to form an insulation band of the concentric wet-mate connector assemble to electrically insulate the electrical connection between the male portion 300 and the female portion 400.

At block 616, process 600 involves electrically connecting the female electrical contact 416 and the male electrical contact 316. An electrical connection may be formed due to positioning the male electrical contact 316 and the female electrical contact 416 in proximity to each other and in mechanical contact. In some examples, the female portion 400 can have multiple female electrical contacts and the male portion 300 can have multiple male electrical contacts to establish multiple electrical contact points between the male portion 300 and the female portion 400 of the concentric wet-mate connector assembly. Each of the additional male and female electrical contacts can be concentric, and when the male portion 300 and the female portion 400 are joined together, multiple independent electric channels can be formed. In these examples, each independent channel formed by the multiple female electrical contact and multiple male electrical contacts can have a separated chamber on the respective male insulation band 314 and female insulation band 414 when the female portion 400 and the male portion 300 are mated together. The multi-channel wet-mate assembly connector with multiple connection points on the male portion 300 and the female portion 400 each may be isolated by separate contact seals thereby forming multiple contact chambers. Each of the multiple contact chambers may be independently compensated.

In some examples, the male portion 300 may have a removable cover on the male electrical contact 316. The removable cover can be concentric such that the removable cover completely covers the male electrical contact 316. Additionally, the female portion 400 can have a shoulder positioned on the female portion. When the male electrical contact 316 is coupled to the female electrical contact 416 by inserting the male portion 300 into the female portion 400, the shoulder positioned on the female portion 400 can remove the removable cover from the male electrical contact 316 in response to bringing the male portion 300 and the female portion 400 together. Utilizing a removable cover can protect the male electrical contact 316 from damage, corrosion, or other environmental impacts before establishing the electrical connection.

In some aspects, apparatuses, methods, and systems for a concentric wet-mate connector assembly for downhole power transmission within a wellbore are provided according to one or more of the following examples.

As used below, any reference to a series of examples is to be understood as a reference to each of those examples disjunctively (e.g., "Examples 1-4" is to be understood as "Examples 1, 2, 3, or 4").

Example 1 is a concentric wet-mate connector assembly comprising: a male portion comprising a male electrical contact and a male insulation band positionable on a surface of the male portion; and a female portion comprising a female electrical contact and a ceramic female insulation band formable on a surface of the female portion, the female portion positionable to coaxially receive the male portion to form an electrical connection with the male portion, wherein the male insulation band and the ceramic female insulation band together form an insulator chamber of the concentric wet-mate connector assembly.

Example 2 is the concentric wet-mate connector assembly of example 1, wherein the ceramic female insulation band is a ring of Magnesia Partially Stabilized Zirconia (Mg-PSZ), and wherein the ceramic female insulation band is formable on the surface of the female portion through a shrink fit to create a hermetic seal between the ceramic female insulation band and the surface of the female portion.

Example 3 is the concentric wet-mate connector assembly of example(s) 1-2, further comprising a bonding material between the ceramic female insulation band and the female portion.

Example 4 is the concentric wet-mate connector assembly of example(s) 1-3, wherein the ceramic female insulation band comprises Mg-PSZ, Silicon Nitride ($Si_3N_4$), Silicon Carbide (SiC), Yttria Partially Stabilized Zirconia (YPSZ), single crystal sapphire, Ceria Partially Stabilized Zirconia (Ce-PSZ), fully stabilized Zirconia, Zirconia Toughened Alumina (ZTA), or any combination thereof.

Example 5 is the concentric wet-mate connector assembly of example(s) 1-4, wherein the female electrical contact comprises a vapor deposited metalized ring positionable on the ceramic female insulation band.

Example 6 is the concentric wet-mate connector assembly of example(s) 1-5, wherein the male insulator band comprises a nickel alloy, steel, titanium, or a combination thereof.

Example 7 is the concentric wet-mate connector assembly of example(s) 1-6, wherein the male insulator band further comprises a dielectric coating layer positionable on a portion of the male insulator band, wherein the dielectric coating layer contacts the ceramic female insulation band when the male portion and the female portion are joined together, and wherein a thickness of the dielectric coating layer is between 1 and 500 microns.

Example 8 is the concentric wet-mate connector assembly of example(s) 1-7, wherein the male portion further comprises a plurality of male electrical contacts and wherein the female portion further comprises a plurality of female electrical contacts positionable to receive the plurality of male electrical contacts to form a plurality of electrical connections between the male portion and the female portion.

Example 9 is the concentric wet-mate connector assembly of example(s) 1-8, wherein the male electrical contact is positionable at least partially within the male insulation band, and wherein the female electrical contact is positionable at least partially within the ceramic female insulation band.

Example 10 is the concentric wet-mate connector assembly of example(s) 1-9, further comprising a contact chamber positionable between the male portion and the female portion when the female portion receives the male portion, wherein the contact chamber is electrically insulated by the male insulation band and the ceramic female insulation band of the wet-mate connector assembly, and wherein the contact chamber is filled with a dielectric grease fluid and the contact chamber is pressure compensated.

Example 11 is the concentric wet-mate connector assembly of example(s) 1-10, wherein the male electrical contact and the female electrical contact are concentric.

Example 12 is the concentric wet-mate connector assembly of example(s) 1-11, wherein: the male portion further comprises: a male compensated chamber positionable in the surface of the male portion; and a male electrical termination positionable inside the male compensated chamber and through the male insulation band, wherein the male electrical termination is electrically coupled to the male electrical contact; and the female portion further comprises: a female compensated chamber positionable in the surface of the female portion; and a female electrical termination positionable inside the female compensated chamber and passing through the ceramic female insulation band, wherein the female electrical termination is electrically coupled to the female electrical contact.

Example 13 is a system comprising: a control line positionable in a wellbore; and a concentric wet-mate connector assembly couplable with the control line and positionable in a downhole portion of the wellbore, the concentric wet-mate connector assembly comprising: a male portion comprising a male electrical contact and a male insulation band formed on a surface of the male portion; and a female portion comprising a female electrical contact and a ceramic female insulation band formable on a surface of the female portion, the female portion positionable to coaxially receive the male portion to form an electrical connection with the male portion, wherein the male insulation band and the ceramic female insulation band together form an insulator chamber of the concentric wet-mate connector assembly.

Example 14 is the system of example 13, wherein the ceramic female insulation band comprises a ring of Mg-PSZ, and wherein the ceramic female insulation band is formable on the surface of the female portion through a shrink fit to create a hermetic seal between the ceramic female insulation band and the surface of the female portion.

Example 15 is the system of example(s) 13-14, wherein an operating voltage of the concentric wet-mate connector assembly is between 0 V and 5,000 V, an operating power level of the concentric wet-mate connector assembly is between 0 W and 5,000 W, and an operating temperature of the concentric wet-mate connector assembly is between −100° C. and above 250° C.

Example 16 is the system of example(s) 13-15, wherein the male electrical contact, the female electrical contact, the male insulation band, and the ceramic female insulation band are concentric.

Example 17 is a female portion of a concentric wet-mate connector assembly comprising: a female electrical contact; and a ceramic female insulation band formable on a surface of the female portion, the female portion positionable to coaxially receive a male portion of the concentric wet-mate connector assembly to form an electrical connection with the male portion, and the ceramic female insulation band positionable with the male insulation band to form an insulator chamber of the concentric wet-mate connector assembly.

Example 18 is the female portion of a concentric wet-mate connector assembly of example 17, wherein the ceramic female insulation band is a ring of Magnesia Partially Stabilized Zirconia (Mg-PSZ), and wherein the ceramic female insulation band is formable on the surface of the female portion through a shrink fit to create a hermetic seal between the ceramic female insulation band and the surface of the female portion.

Example 19 is the female portion of a concentric wet-mate connector assembly of example(s) 17-18, wherein the female electrical contact and the ceramic female insulation band are concentric.

Example 20 is the female portion of a concentric wet-mate connector assembly of example(s) 17-19, further comprising a bonding material between the ceramic female insulation band and the female portion, and wherein the female electrical contact comprises a vapor deposited metalized ring positionable on the ceramic female insulation band. The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A concentric wet-mate connector assembly comprising:

a male portion comprising a male electrical contact and a male insulation band positionable on a surface of the male portion; and a female portion configured for downhole use comprising a female electrical contact and a ceramic female insulation band formed on a surface of the female portion, wherein the ceramic female insulation band is formed on the surface of the female portion through a shrink fit to create a hermetic seal between the ceramic female insulation band and the surface of the female portion without use of a sealing member between the female portion and the ceramic female insulation band, wherein the female portion is positionable to coaxially receive the male portion to form an electrical connection with the male portion, and wherein the male insulation band and the ceramic female insulation band together form an insulator chamber of the concentric wet-mate connector assembly.

2. The concentric wet-mate connector assembly of claim 1, wherein the ceramic female insulation band is a ring of Magnesia Partially Stabilized Zirconia (Mg-PSZ).

3. The concentric wet-mate connector assembly of claim 1, further comprising a bonding material between the ceramic female insulation band and the female portion.

4. The concentric wet-mate connector assembly of claim 1, wherein the ceramic female insulation band comprises Mg-PSZ, Silicon Nitride ($Si_3N_4$), Silicon Carbide (SIC), Yttria Partially Stabilized Zirconia (YPSZ), single crystal sapphire, Ceria Partially Stabilized Zirconia (Ce-PSZ), fully stabilized Zirconia, Zirconia Toughened Alumina (ZTA), or any combination thereof.

5. The concentric wet-mate connector assembly of claim 1, wherein the female electrical contact comprises a vapor deposited metalized ring positionable on the ceramic female insulation band.

6. The concentric wet-mate connector assembly of claim 1, wherein the male insulator band comprises a nickel alloy, steel, titanium, or a combination thereof.

7. The concentric wet-mate connector assembly of claim 1, wherein the male insulator band further comprises a dielectric coating layer positionable on a portion of the male insulator band, wherein the dielectric coating layer is positionable to contact the ceramic female insulation band while the male portion and the female portion are joined together, and wherein a thickness of the dielectric coating layer is between 1 and 500 microns.

8. The concentric wet-mate connector assembly of claim 1, wherein the male portion further comprises a plurality of male electrical contacts and wherein the female portion further comprises a plurality of female electrical contacts positionable to receive the plurality of male electrical contacts to form a plurality of electrical connections between the male portion and the female portion.

9. The concentric wet-mate connector assembly of claim 1, wherein the male electrical contact is positionable at least partially within the male insulation band, and wherein the female electrical contact is positionable at least partially within the ceramic female insulation band.

10. The concentric wet-mate connector assembly of claim 1, wherein the insulator chamber is filled with a dielectric grease fluid, and the insulator chamber is pressure compensated.

11. The concentric wet-mate connector assembly of claim 1, wherein the male electrical contact and the female electrical contact are concentric.

12. The concentric wet-mate connector assembly of claim 1, wherein:

the male portion further comprises:

a male compensated chamber positionable in the surface of the male portion; and a male electrical termination positionable inside the male compensated chamber and through the male insulation band, wherein the male electrical termination is electrically coupled to the male electrical contact; and the female portion further comprises:

a female compensated chamber positionable in the surface of the female portion; and a female electrical termination positionable inside the female compensated chamber and passing through the ceramic female insulation band, wherein the female electrical termination is electrically coupled to the female electrical contact.

13. A system comprising:

a control line positionable in a wellbore; and a concentric wet-mate connector assembly couplable with the control line and positionable in a downhole portion of the wellbore, the concentric wet-mate connector assembly comprising:

a male portion comprising a male electrical contact and a male insulation band formed on a surface of the male portion; and a female portion comprising a female electrical contact and a ceramic female insulation band formed on a surface of the female portion, wherein the ceramic female insulation band is formed on the surface of the female portion through a shrink fit to create a hermetic seal between the ceramic female insulation band and the surface of the female portion without use of a sealing member between the female portion and the ceramic female insulation band, wherein the female portion is positionable to coaxially receive the male portion to form an electrical connection with the male portion, and wherein the male insulation band and the ceramic female insulation band together form an insulator chamber of the concentric wet-mate connector assembly.

14. The system of claim 13, wherein the ceramic female insulation band comprises a ring of Mg-PSZ.

15. The system of claim 13, wherein an operating voltage of the concentric wet- mate connector assembly is between 0 V and 5,000 V, an operating power level of the concentric wet-mate connector assembly is between 0 W and 5,000 W, and an operating temperature of the concentric wet-mate connector assembly is between −100° C. and above 250° C.

16. The system of claim 13, wherein the male electrical contact, the female electrical contact, the male insulation band, and the ceramic female insulation band are concentric.

17. A female portion of a concentric wet-mate connector assembly for downhole use comprising:

a female electrical contact; and a ceramic female insulation band formed on a surface of the female portion through shrink fit to create a hermetic seal between the ceramic female insulation band and the surface of the female portion without use of a sealing member between the female portion and the ceramic female insulation band, wherein the female portion is configured for downhole use and positionable to coaxially receive a male portion of the concentric wet-mate connector assembly to form an electrical connection with the male portion, and wherein the ceramic female insulation band is positionable with a male insulation band to form an insulator chamber of the concentric wet-mate connector assembly.

18. The female portion of the concentric wet-mate connector assembly of claim 17, wherein the ceramic female insulation band is a ring of Magnesia Partially Stabilized Zirconia (Mg-PSZ).

19. The female portion of the concentric wet-mate connector assembly of claim 17, wherein the female electrical contact and the ceramic female insulation band are concentric.

20. The female portion of the concentric wet-mate connector assembly of claim 17, further comprising a bonding material between the ceramic female insulation band and the female portion, and wherein the female electrical contact comprises a vapor deposited metalized ring positionable on the ceramic female insulation band.

* * * * *